US006873113B2

(12) United States Patent
Dandl et al.

(10) Patent No.: US 6,873,113 B2
(45) Date of Patent: Mar. 29, 2005

(54) STAND ALONE PLASMA VACUUM PUMP

(75) Inventors: Raphael A. Dandl, San Marcos, CA (US); Bill H. Quon, Tempe, AZ (US)

(73) Assignees: Tokyo Electron Limited, Tokyo (JP); James P. Gallagher, Scottsdale, AZ (US)

( * ) Notice: Subject to any disclaimer, the term of this patent is extended or adjusted under 35 U.S.C. 154(b) by 164 days.

(21) Appl. No.: 10/268,970

(22) Filed: Oct. 11, 2002

(65) Prior Publication Data

US 2003/0122492 A1 Jul. 3, 2003

Related U.S. Application Data

(63) Continuation of application No. PCT/US01/11111, filed on Apr. 6, 2001.

(60) Provisional application No. 60/196,920, filed on Apr. 13, 2000.

(51) Int. Cl.[7] ..... F04B 37/02

(52) U.S. Cl. ..... 315/111.71; 315/111.81; 417/48; 417/50

(58) Field of Search ..... 315/111.91, 111.81, 315/111.71, 111.21, 111.41; 417/48, 49, 50; 156/345.41, 345.42; 118/723 MW, 723 MI, 723 MR

(56) References Cited

U.S. PATENT DOCUMENTS

| | | | | |
|---|---|---|---|---|
| 3,555,331 A | | 1/1971 | Chuan | 417/48 |
| 3,994,625 A | | 11/1976 | Welch | 417/49 |
| 4,401,054 A | * | 8/1983 | Matsuo et al. | 118/723 MR |
| 4,512,868 A | | 4/1985 | Fujimura et al. | 204/298.38 |
| 4,641,060 A | | 2/1987 | Dandl | 315/111.71 |
| 4,745,337 A | | 5/1988 | Pichot et al. | 315/111.21 |
| 4,883,570 A | | 11/1989 | Efthimion et al. | 315/111.21 |

(Continued)

OTHER PUBLICATIONS

Dandl et al. "On the low–pressure mode transition in electron cyclotron heated plasmas," J.Vac.Sci.Technol. A (6), Nov./Dec. 1991, pp. 3119–3125.

Worden, David G., editor, "Flow of gases throgh tubes and orifices," Chapter 2, Scientific Foundations of Vacuum Technique, 2$^{nd}$ ed., John Wiley & Sons, Inc., 1969, pp. 80–117.

Quon et al., "Preferential electron–cyclotron heating of hot electrons and formation of overdense plasmas," Physics of Fluids B Plasma Physics, American Institute of Physics, vol. 1, No. 10, Oct. 1989, pp. 2010–2017.

Guest et al., "Whistler–wave electron cyclotron heating in uniform and nonuniform magnetic fields," Physics of Fluids B Plasma Physics, American Institute of Physics, vol. 2, No. 6, Part 1, Jun. 1990, pp. 1210–1220.

Rose et al., "Motion of individual charges," Chapter 10, Plasmas and Controlled Fusion, M.I.T. Press and John Wiley & Sons, Inc., 1961, pp. 198–227.

*Primary Examiner*—Tuyet Vo
*Assistant Examiner*—Ephrem Alemu
(74) *Attorney, Agent, or Firm*—Pillsbury Winthrop LLP

(57) ABSTRACT

A stand-alone plasma vacuum pump for pumping gas from a low-pressure inlet to a high-pressure outlet, composed of: a housing enclosing one or more pumping regions located between the inlet and the outlet; a plurality of permanent magnet assemblies providing magnetic fields that extend in the pumping region between the inlet and the outlet, the magnetic field forming magnetic flux channels for guiding and confining plasmas; elements disposed for coupling microwave power into the flux channels to heat electrons, ionize gas, and accelerate plasma ions in a direction from the inlet to the outlet; elements disposed for creating an electric in the magnetic flux channels to accelerate ions in the flux channels toward the outlet by momentum transfer; and a differential conductance baffle proximate to the outlet for promoting flow of plasma ions and neutral atoms to the outlet.

16 Claims, 6 Drawing Sheets

U.S. PATENT DOCUMENTS

| | | | | | |
|---|---|---|---|---|---|
| 4,902,934 | A | | 2/1990 | Miyamura et al. | 315/111.21 |
| 4,933,650 | A | * | 6/1990 | Okamoto | 315/111.41 |
| 5,024,716 | A | | 6/1991 | Sato | 156/345.42 |
| 5,133,826 | A | | 7/1992 | Dandl | 156/345.42 |
| 5,165,861 | A | | 11/1992 | Jahns | 417/50 |
| 5,198,725 | A | | 3/1993 | Chen et al. | 315/111.21 |
| 5,203,960 | A | | 4/1993 | Dandl | 204/298.37 |
| 5,240,381 | A | | 8/1993 | Nagai et al. | 417/48 |
| 5,256,036 | A | | 10/1993 | Cole | 417/48 |
| 5,296,714 | A | | 3/1994 | Treglio | 315/111.41 |
| 5,370,765 | A | | 12/1994 | Dandl | 118/72 MA |
| 5,453,125 | A | | 9/1995 | Krogh | 118/723 MR |
| 5,754,008 | A | | 5/1998 | Wartski et al. | 315/111.91 |
| 5,762,814 | A | | 6/1998 | Ohara et al. | 118/723 MA |
| 5,824,607 | A | | 10/1998 | Trow et al. | 118/723 MA |
| 5,855,686 | A | | 1/1999 | Rust | 118/723 E |
| 5,948,168 | A | | 9/1999 | Shan et al. | 118/723 R |
| 5,975,855 | A | | 11/1999 | Ensberg et al. | 417/49 |
| 5,985,091 | A | | 11/1999 | Suzuki | 156/345.42 |
| 6,422,825 | B2 | | 7/2002 | Dandl et al. | 417/48 |
| 6,559,601 | B1 | * | 5/2003 | Johnson et al. | 315/111.71 |

* cited by examiner

STAND ALONE PLASMA VACUUM PUMP

This is a continuation of International Application No. PCT/US01/11111, which was filed on Apr. 6, 2001, and also claims benefit of U.S. application No. 60/196,920, which was filed Apr. 13, 2000, the contents of both of which are incorporated herein in their entirety.

BACKGROUND OF THE INVENTION

The present invention relates to industrial and other processes in which large volumes of gases must be pumped at pressures as low as 1–10 milliTorr. Industrial processes in this category include, for example, various types of plasma processing, such as plasma enhanced chemical vapor deposition, plasma mediated etching of surfaces, and other types of surface modification processes.

In many such processes employing plasmas, it is generally considered by those skilled in the art to be advantageous to generate the processing plasmas in suitable mixtures of gases maintained at pressures as low as 1–10 milliTorr. The purity and composition of the gas can best be controlled if the flow rate of fresh gas into the processing chamber is high relative to the processing rate. However, existing vacuum pumping technology can provide only limited throughput of gas in this pressure range.

The pumping speed of widely used turbomolecular vacuum pumps, for example, generally decreases rapidly with increasing pressure at pressures above roughly 1 milliTorr. Robust, cost-effective systems for achieving high-speed pumping in the pressure range from 1–10 milliTorr have not been developed to date.

Furthermore, many gases involved in industrial processing of, for example, VLSI systems are toxic or hazardous and must be isolated and controlled with great care. It would be advantageous if the toxic or hazardous gases to be exhausted from the processing chambers could be converted into less toxic or hazardous forms through dissociation of the molecules of such gases. This process is often referred to as pyrolyzation of toxic or hazardous gases and has been investigated for many years, particularly in connection with toxic gases used by the military.

Conventional vacuum pumping technology utilizes one of two fundamental mechanisms: (1) increasing the momentum of gas molecules in a preferred direction and exhausting the gas molecules through a valve or baffle structure which inhibits the reverse flow of gas; or (2) condensing the gas to be pumped on special surfaces. The first mechanism is usually implemented through some type of piston, blower, or rapidly moving vanes which impart directed momentum to the gas from rapidly moving mechanical structures or streams of pumping molecules, such as mercury or readily condensable pumping oils. The second mechanism is commonly used in systems with low to moderate throughput requirements. In the range of pressures where industrial plasma processes are carried out (1–100 milliTorr), turbomolecular pumps are used almost universally as the first stage of a compound pumping system designed to pump large fluxes ("throughputs") of process gases.

Turbomolecular pumps impart directed momentum to gas molecules through collisions with rapidly spinning discs. This mechanism is most effective at sufficiently low gas pressures that the mean-free-path of the molecules is larger than the dimensions of the pumping structures. The resulting limit on maximum gas throughput that can be achieved with turbomolecular pumps is a drawback in the plasma processing industry where substantial throughputs of reactant gases are needed to prevent the buildup of reaction products to concentrations that would be deleterious to the process. Further, high-speed turbomolecular pumps are necessarily complex and expensive devices, in which large angular momentum is stored. Moreover, many plasma processes yield solid and/or corrosive byproducts that can be potentially damaging to these pumps.

The ability to pump at 3 to 5 times the presently available pumping speed has been shown (using smaller substrates) to enhance the reliability of the process and performance of etch and deposition processes. The present limit of pumping speed in a properly designed system is determined both by the speed of the pump and the conductance of the chamber to the pump inlet. At present the capability of turbomolecular pumps is limited to 5500 liters per second; although the use of the largest available turbomolecular pumps is further limited by the cost of the large pumps and the expected lack of reliability of a pump this large. The cost of a turbomolecular pump of this size exceeds $80,000, which, at $15.5/(liter/sec), is considerably higher in cost per unit of pumping speed than the $30,000, or $10.6/(liter/sec), for a 3300-liter per second pump. Thus, the cost per unit pumping speed for the larger pumps is 50% greater than for the smaller pumps.

Even so, the 5500 liters/second (1/sec) pump is smaller than would be optimum for processing 200 mm wafers. Extension to 300 mm wafers significantly exacerbates the problem of providing adequate pumping speed. The required pumping speed scales most closely with the area of the substrate. The scaling of process equipment to from 200 mm to 300 mm wafers requires at least a 2.25× increase in pumping speed. The available increase from 3300 liter/second to 5500 liter/second is only an increase of 1.67×. This leaves the 300 mm systems with pumping options that are grossly inadequate.

The problem of gas handling in 300 mm systems is complicated even further by the fact that it is the pumping speed at the wafer (substrate) that is most important. Providing pumping speed at a location remote from the wafer means that the gas atoms must be conducted to the pump inlet through some transitional structure. In the transition region there are invariably reductions in conductance, which is typically measured in liters/sec. Computer programs can predict the overall pumping speed when the gas atoms are in the laminar or molecular flow regimes. In most processes of commercial interest, however, the flow is characterized as transition flow and the computer models are less reliable in predicting performance. The conductance between the wafer and the pump in most designs provides a loss of at least 50%–75% in effective pumping speed.

In addition, the effective handling of gas flow must account for the gas species that must be removed from the system but spend much time attached to the processing chamber walls. A similar problem occurs with any barely volatile species that may result from the process itself, for example, multiple carbon species that are polymerized either by the electrons or photons of the plasma. It is easy for the plasma electron or photon flux to affix these fragments of molecules to the walls. In the same way these materials are subsequently released from the walls, perhaps as a different species. The same processes of attachment, synthesis, decomposition and evolution occur at the substrate but with the difference that the substrate is of different material and has the additional energy flux of the ion bombardment that is used, for example, to promote the etch process. The substrate is a source of organic material and silicon from the etch process. If this flow of new material ceases when the wafer bias is removed the reactor tends to stabilize in that the active groups that are volatile become combined into the degenerate brown film that is often seen in plasma processing systems. This material is highly cross-linked and very stable with respect to thermal desorption or plasma bombardment.

The quality of the process results depends in considerable measure upon the presence or absence of weakly volatile materials such as, for example, in the use of side-wall passivation to provide straight walls in high aspect ratio channels. This passivation results from the deposition of material that originated as photoresist and injected gas and is modified by the electron collisions as a free molecule in the plasma volume and may undergo multiple changes while adsorbed on surfaces. This material is then redeposited on the wafer surface specifically in the freshly etched surface of the feature being etched. The deposited material having experienced multiple interactions with the plasma is particularly resistant to decomposition by the ions and chemically reactive molecules that provide the flux that etches the wafer. Probably much of the process dynamics that allow selectivity between organic surfaces and surfaces that are more inorganic (the plasma tends to spread molecular species to all surfaces in the plasma) are affected by changes in the thin volume of the wall that is in contact with the plasma. For these reasons, if the residence time for these species in the process chamber could be reduced significantly, perhaps shorter that some accommodation time (the time for them to find this stable chemical site), then etch chemistry in the chamber could be controlled and optimized.

For some time there has been a growing appreciation of the possible benefits of using plasmas as the active element in vacuum pumping technologies; for example, plasmas can pump a wide range of gasses, including hydrogen and helium, with equally high efficiencies. Plasma vacuum pumps can be highly tolerant of solid or corrosive process by-products. As described herein, these benefits result from the generic underlying properties of plasma vacuum pumps, in which three-dimensional flow of the neutral gas to be pumped is transformed into one-dimensional flow of a magnetized plasma which can be magnetically compressed and guided through suitable baffle structures. Neutral gas is composed of neutral, i.e. non-ionized, atoms and molecules. Momentum can be imparted to the plasma through various electromagnetic interactions and, in turn, to the neutral gas through collisions between energetic charged particles and neutral gas molecules.

These potential benefits have not yet been fully realized in practice for a number of technical reasons relating to efficient generation of plasma, the creation of a magnetic field suitable for both the plasma generation and the necessary channeling of the plasma flow, and simple and effective mechanisms for driving the plasma flow at pressures in the range of importance to plasma processing applications. This last technical difficulty is exacerbated by the plasma's ability to shield its interior from low-frequency external electric fields, together with the complex atomic and molecular processes that become important in the pressure range of interest.

Another type of plasma vacuum pump is disclosed in International Application No. PCT/US99/12827, filed on Jun. 29, 1999, entitled PLASMA VACUUM PUMPING CELL, the entire disclosure of which is incorporated herein by reference, and pending U.S. Provisional Application No. 60/114,453, filed on Dec. 30, 1998, entitled PLASMA VACUUM PUMP, the entire disclosure of which is incorporated herein by reference. This pump utilizes the plasma excited in a processing system by a high-density plasma source, such as a plasma utilizing electron cyclotron resonance (ECR), an inductively coupled plasma (ICP), or an electrostatically shielded radio frequency (ESRF) plasma, to pump gas out of the system. This type of pumping cell must be designed and built according to the source plasma properties of the system in which it is to be installed. It can not be used as a stand-alone vacuum pump.

BRIEF SUMMARY OF THE INVENTION

According to the invention, a stand-alone plasma vacuum pump for pumping gas from a low-pressure inlet to high-pressure outlet combines an electron cyclotron resonance effect with a specially shaped permanent magnet field to propel ions from the inlet to the outlet. The plasma vacuum pump includes a housing enclosing a pumping region located between the inlet and the outlet, a plurality of permanent magnet assemblies providing magnetic fields that extend in the pumping region between the inlet and the outlet, the magnetic fields providing at least one magnetic flux channel for guiding and confining a plasma, and a source of microwave power coupled into the flux channel to heat plasma electrons, ionize the gas, and create forces that propel plasma ions in a direction from the inlet toward the outlet. The pump is further constructed to promote the flow of plasma and electrically neutral gas molecules toward the outlet while impeding flow of neutral gas molecules in the direction from the outlet toward the inlet.

A plasma vacuum pump according to the invention is especially well suited for pyrolyzing effluent gases, in that all gases to be pumped must pass through a region populated by electrons with enough energy and density to ionize the gas molecules which enter the region with high efficiency. The resulting molecular ions will generally dissociate into the constituent atomic species in times that are less than their transit time through the pump.

A pump according to the invention employs four separate and distinct plasma technologies in a novel configuration. The first is electron cyclotron heating technology that provides efficient ionization of the neutral gas to be pumped. The second is plasma confinement technology that confines a plasma which results from electron cyclotron heating within the pumping duct by creating at least one magnetic flux channel having the cross sectional shape of an asymmetric magnetic mirror. The third is a momentum-transfer-pumping technology that drives the electron cyclotron heated plasma along the magnetic flux channel. The fourth is baffle technology that allows unrestricted outward-directed plasma flow but impedes the back-stream of thermalized neutral gas molecules.

According to one novel aspect of the present invention, a single longitudinally extended plasma region is generated in a magnetic flux channel within a rectangular pumping duct. Alternatively, 4, 8, or more longitudinally extended plasma regions are each generated in a respective flux channel within a cylindrical enclosure. In this form of construction, the channels are spaced apart around the axis of the cylindrical enclosure, each channel extends along that axis, and each channel is formed to pump gas in a radial direction. This cylindrical configuration provides a very large pumping surface area to accommodate large gas loads. In addition, neutral gas molecules can enter the enclosure and travel parallel to the axis of the enclosure in the space or spaces between the plasma regions. As the gas molecules pass through the electron cyclotron resonance region, most of the incident molecules will be ionized by energetic electrons which accumulate within this region as the result of electron cyclotron heating. Once the molecules are ionized they can escape the plasma pump essentially over only a small solid angle at the outlet end of each flux channel.

Electron cyclotron heating serves two essential functions in the invention. It provides a flexible and efficient means for heating electrons to energies around 100 eV, at which energy inelastic electron collisions with gas molecules have their greatest probability of ionizing the molecules. In addition, electron cyclotron heating in the magnetic field configuration of the invention creates internal space-charge electric fields that accelerate ions along the magnetic lines of force.

According to a second novel aspect of the present invention, each flux channel is defined by a very efficient magnetic field configuration created using permanent magnets. The magnetic field plays three important roles in the plasma pump mechanism: (1) it delimits an electron cyclotron resonance (ECR) zone for effective electron heating and plasma production, (2) it provides a diverging, expanding, magnetic flux tube or channel within which there are diverging magnetic lines of force, or flux lines, or a decreasing magnetic field strength, and within which the kinetic energy associated with the orbiting movement of electrons in a direction normal to the magnetic field lines is converted to kinetic energy associated with electron movement parallel to the magnetic field lines, and (3) it guides the plasma flow from the ECR resonance region, through the momentum-transfer pumping ducts and a baffle, and into a fore-pump region. All three roles are accomplished with minimal amounts of permanent magnet materials.

A magnetic flux tube is generally defined as a region in space whose transverse surfaces are everywhere parallel to magnetic lines of force. A comprehensive discussion of magnetic flux tubes is given, for example, in "The Structure of Magnetic Fields", by A. I. Morozov and L. S. Solov'ev, in *Reviews of Plasma Physics*, Vol. 2, pages 9–11, Ed. M. A. Leontovich, Consultants Bureau, New York, 1966. In the rectangular embodiment of the invention magnetic lines of force lie in planes. In Cartesian coordinates these planes can be chosen to be planes on which the coordinate z is constant, so that the magnetic field has only x- and y-components. The magnetic flux tubes or channels extend the length of the magnetic structure in the z-direction. In the cylindrical embodiment the magnetic lines of force lie in planes on which the axial coordinate, z, is constant. The magnetic field has components in the radial, r, and azimuthal directions. The magnetic flux tubes or channels extend the length of the magnetic structure in the axial, z-direction.

In an ECR resonance zone, a high-density plasma with a density of $10^{12}$–$10^{13}$ ions/cm$^3$ is generated by whistler waves launched from high magnetic field regions near a microwave antenna. As shown by R. A. Dandl and G. E. Guest ("On the Low-Pressure Mode Transition in Electron Cyclotron Heated Plasmas", J. Vac. Sci. Technol. A9(6), November/December 1991, pp.3119–3125) the density produced is approximately proportional to the microwave power coupled into the plasma region.

This plasma contains primary and secondary electrons. The primary resonantly-heated electrons may have energies approaching 100 eV. These electrons are highly ionizing, and are capable of ionizing a large flux of gas molecules, provided adequate electron cyclotron heating power is provided, and thus achieving a high pumping speed. The temperature of the secondary electrons resulting from impact ionization of incident gas molecules is in the range of 3–10 eV, depending on the heating power and operating pressure.

According to a further novel aspect of the present invention, the plasma ions are accelerated collectively by an internal space-charge electric field in the region of diverging magnetic field lines downstream from the ECR zone.

According to a still further novel aspect of the present invention, directed neutral gas flow in each flux channel is strongly enhanced in that the neutral gas atoms gain directed momentum rapidly from resonant charge-exchange and other collisions with the plasma ions. In this way, parallel momentum is continuously transferred to the neutral molecules, while the newly charge-exchanged ions quickly gain directed energy from the collective electric field. Plasma ions may subsequently recombine with plasma electrons at the flux channel exit, where backward flow of neutral molecules is impeded. Since the plasma readily flows along the converging magnetic lines of force, it can be guided through a suitably restricted exit orifice; i.e., the geometry of the pumping ducts may be made to coincide with the magnetic field lines. Using criteria familiar in the art (see, for example, Scientific Foundations of Vacuum Technique, Second Edition, by Saul Dushman, Ed. J. M. Lafferty, John Wiley and Sons, New York, (1962) Chapter 2) the dimensions of the exit orifice can be chosen to restrict the flow of gas from the high-pressure outlet side of the orifice to the low-pressure inlet side. In this way the backward flow rate of gas through the orifice can be made smaller than the forward flow rate of plasma and entrained gas.

The construction and performance of the pumping ducts will be discussed in more detail below.

DETAILED DESCRIPTION OF THE INVENTION

Figure 1:
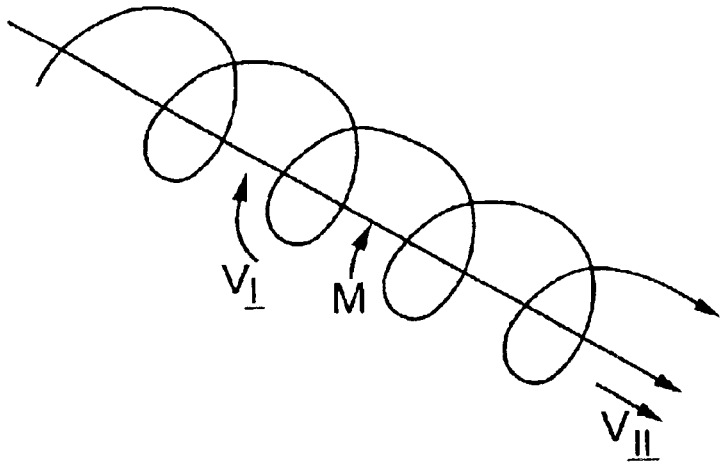
FIG. 1 is a pictorial view depicting supra-thermal electron motion in a magnetic field.

FIG. 1 illustrates the helical trajectory of an electron moving in a static magnetic field having lines of force which extend in the general direction of arrow M. As is well known in the art and described more fully in, for example, *Plasmas and Controlled Fusion*, by David J. Rose and Melville Clark, Jr., John Wiley and Sons, New York (1961) Chapter 10, the helical trajectory illustrated in FIG. 1 can be regarded as resulting from the superposition of a transverse rotational motion ("gyration") around the magnetic lines of force and a lineal motion along the magnetic line of force. The angular frequency of the gyration (the "electron gyrofrequency"), $\Omega_e$, is proportional to the magnitude of the magnetic field strength, B=|B|:

$$\Omega_e=2\pi f_e=eB/m$$

Here e and m are the electric charge and mass of the electron, respectively. In a magnetic field of 875 Gauss, for example, the electron gyrofrequency, $f_e$, equals 2.45 GHz, the frequency of the microwave power used in many commercial applications.

If microwave power of some particular frequency, $f_\mu$, is radiated into a region in space where the magnetic field strength has the value at which the electron gyrofrequency equals the frequency of the microwave power, electrons will undergo continuous acceleration transverse to the magnetic field for as long as they remain in this "resonance region". The resonant value of the magnetic field strength is given by $$B_{res}=f_\mu(m/2\pi e)$$

As is know in the art, this resonant acceleration can readily increase the electron kinetic energy by more than 100 eV before electrons move out of the resonance region. Such resonantly heated electrons can thus have energies which are optimum for ionizing any gas molecules with which they may collide.

Provided the magnetic field strength varies sufficiently gradually in space, the electron motion can be further characterized by the magnetic moment associated with its (transverse) gyration. The gyrating electron constitutes a microscopic current loop whose current is $j_e=ef_e$. Moreover, if the electron velocity transverse to the magnetic field has the magnitude $v_\perp$, then the radius of the gyration is given by $\rho_e=v_\perp/\Omega_e$. The magnetic moment associated with the microscopic electron current loop is the product of the current and the area of the loop:

$$\mu_e=j_e\pi\rho_e^2=W_\perp B$$

Here $W_\perp$ is the electron kinetic energy associated with motion transverse to the magnetic field. In a spatially varying magnetic field, electrons will experience a force along the magnetic field given by $-\mu_e\nabla B$, where $\nabla B$ is the gradient of the magnitude of the magnetic field strength. Because this force is antiparallel to the gradient, it will accelerate electrons along the magnetic lines of force toward regions of lower field strength.

Figure 2:
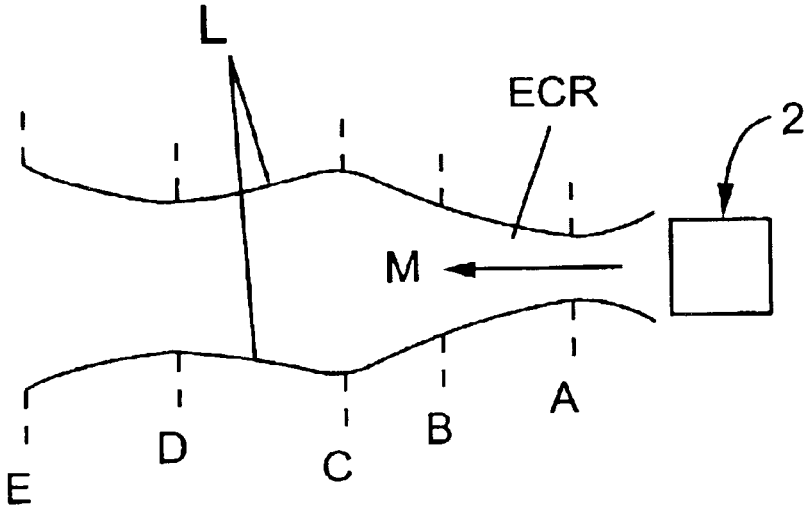
FIG. 2 is a simplified pictorial representation of a magnetic field established in a plasma region according to the present invention.

FIG. 2 is a simplified pictorial view representing a magnetic field that can act in cooperation with an electron cyclotron resonance power source 2, to form a plasma region that produces a pumping action according to the present invention. The magnetic field is represented by two lines L which lie in flux planes that extend perpendicular to the plane of FIG. 2. Each flux plane has linear generatrices in the direction perpendicular to the plane of FIG. 2. The flux pattern of the magnetic field has a form that is mirror symmetrical to a plane that extends perpendicular to the plane of FIG. 2 and that extends horizontally in the plane of FIG. 2 in the direction of arrow M. Arrow M here represents the general direction of the magnetic field as well as the direction in which plasma will be pumped. The illustrated magnetic field forms a flux channel which is made up of four portions each bounded at least approximately by a respective pair of notional boundary planes a, b, c, d and e. It will be noted that the flux channel can have an extent of any magnitude perpendicular to the plane of FIG. 2.

The flux channel has a substantially constant flux density along each line perpendicular to the plane of FIG. 2, while the flux density varies in the direction of arrow M in the manner represented by the form of lines L. Specifically, at each point along the direction of arrow M, the greater the spacing between lines L, the lower the flux density; i.e., the lower the magnetic field strength. Thus, from plane a to plane c, the flux density progressively decreases. while from plane c to plane d it increases and from plane d to plane e it again decreases.

Lines L are not intended to depict the quantitative variations in flux density, but only the qualitative nature and direction of those variations. However, as is illustrated, it is desired that the flux density at plane d be less than that at plane a.

The microwave power source 2 is disposed to introduce high frequency microwave energy into the flux channel to produce high energy electrons and ionize gas molecules in an electron cyclotron resonance zone ECR between planes a and b in which electrons undergo gyration at the resonance frequency, experience a force along the weakening magnetic field and generate an internal space-charge field to accelerate ions along the magnetic field, as discussed earlier. The portion of the flux channel between planes a and b will constitute the preferred location of the inlet end of the flux channel. However gas to be pumped can also be introduced into the portion between planes b and c.

The internal space-charge electric field arises due to the fact that the electrons experience the $-\mu_e\nabla B$ force along the magnetic field between planes a and c, where the flux density is decreasing, thus "separating" from the ions. Consequently, the electrons "drag" the ions through the flux channel by electric forces. This is known in the art.

The plasma ions are thus accelerated collectively by the internal space-charge electric field to drift downstream with the electrons, which are constrained to flow parallel to the magnetic field. Plasma drift energies of tens of electron volts are expected from this acceleration mechanism In the flux channel, downstream of the ECR resonance zone, supra-thermal electrons directly heated in the ECR zone convert part of their energy perpendicular to the magnetic field lines into energy parallel thereto as those electrons move down to plane c. Perpendicular energy herein refers to the kinetic energy associated with the electron velocities perpendicular to the magnetic field lines, i.e., $$W_{perpendicular}\ (\text{or } W_\perp)=\tfrac{1}{2}mv^2\ \text{perpendicular (or } v_\perp^2)$$

Parallel energy is herein referred to the kinetic energy associated with electron velocities in a direction parallel with the magnetic field lines; i.e.

$$W_{parallel}\ (\text{or } W_\parallel)=\tfrac{1}{2}mv^2\text{parallel (or } v_\parallel^2)$$

The electrons and ions continue to move through the magnetic field portion between planes c and d to enter the outlet portion between planes d and e.

Although the flux density in the flux channel has a positive gradient between planes c and d, the electrons and ions have sufficient parallel kinetic energy to move past plane d. This movement is permitted by the fact that the gradient between planes c and d is smaller in magnitude than the gradient between the ECR and plane c.

The electrons and ions then enter the portion between planes d and e, which constitutes the outlet end of the flux channel, where they will recombine into neutral gas and be acted on by a fore-pump. Electrons downstream of plane e see an increasing magnetic field in the flux channel, between planes d and e, which impedes their movement back into the flux channel. The movement of gas in this direction is further impeded by the effective narrowing of the channel at plane d, which reduces the channel cross section as seen from the outlet end of the channel.

In addition, neutral molecules are displaced along the channel by collisions with positive ions travelling down the flux channel.

Figure 3:
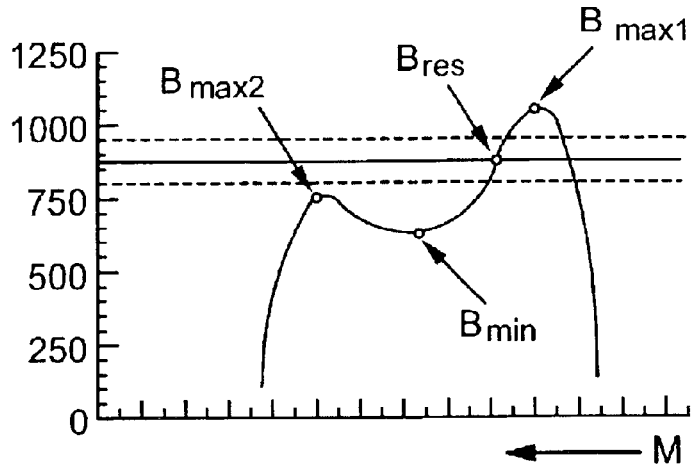
FIG. 3 is a diagram illustrating magnetic flux density variation along the centerline of the magnetic field shown in FIG. 2.

FIG. 3 is a diagram illustrating the variation in flux density along the axis of symmetry of the magnetic field shown in FIG. 2. The magnitude of the magnetic field strength, b, is plotted versus distance the along the axis of symmetry for an illustrative pump intended for use with 2.45 GHz microwave power from source 2. Microwave windows would be located at the position of the peak magnetic field strength, $B_{max1}$ i.e., at plane a, and that field strength may be roughly 1100 Gauss in this example. Shortly thereafter, in the resonance zone, ECR, between planes a and b, the resonance surface, where the $B=B_{res}$, is located at a particular magnetic field strength, for example 875 Gauss. Continuing to the left, the magnetic field lines continue to diverge and the magnetic field strength decreases. The B-field reaches a local minimum $B_{min}$ when the field lines have diverged to their widest extent at plane c. The region on either side of $B_{min}$, within which the magnetic field strength is less than $B_{max}$, resembles a magnetic mirror used for plasma confinement and will be referred to herein as the "mirror region". Then, the field lines converge upon reaching another local maximum $B_{max2}$ (such that, as described later, $B_{max2}<B_{res}$). Note that the peak magnetic field strength $B_{max2}$ proximate to the outlet end is somewhat less than $B_{res}$.

Figure 4:
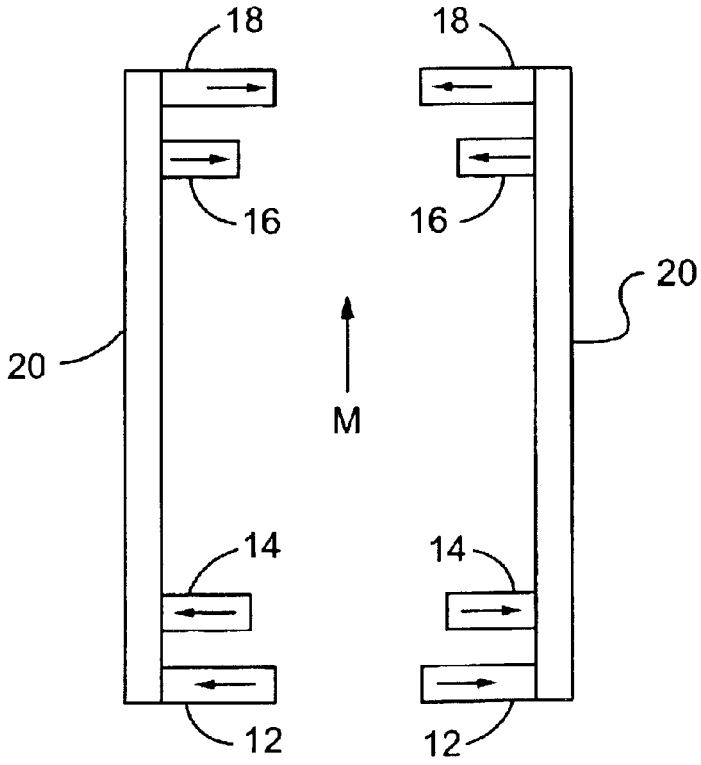
FIG. 4 is a simplified side view depicting one arrangement according to the invention for producing a rectangular embodiment of the magnetic field shown in FIGS. 2 and 3.

FIG. 4 shows one rectangular embodiment of a permanent magnet assembly according to the invention for producing the magnetic field depicted in FIGS. 2 and 3. This embodiment is composed of a single flux channel forming a single pumping region and is made up essentially of the permanent magnet assembly composed of two identical halves. Each half includes four permanent magnets 12, 14, 16 and 18 and a steel pole piece 20 connected between the magnets to provide a magnetic flux return path between the magnets. Each steel pole piece 20 may be made, for example, of 1010 steel. The permanent magnet assembly extends across the entire width of the pumping region, which is perpendicular to the plane of FIG. 4. The directions of magnetization of the magnets are shown by thick black arrows drawn in the magnets. All of these directions can be reversed.

As shown, magnets 12 and 14 are longer than magnets 16 and 18, respectively. This serves to create the field pattern described above. Alternatively, or in addition, magnets 12 and 14 can be made magnetically stronger than magnets 16 and 18, respectively.

In a pumping region according to the invention, source 2 (FIG. 2) will be disposed behind magnets 12 and the outlet end will be at the level of magnets 18.

Figure 5:
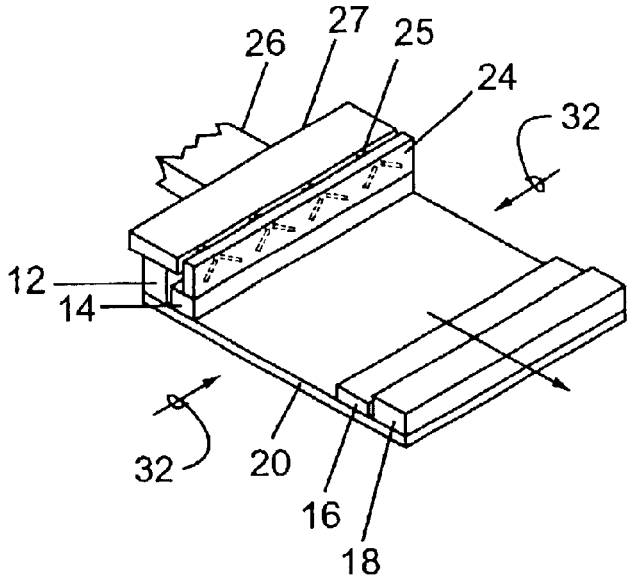
FIG. 5 is a perspective view of the lower part of a simple rectangular embodiment of a stand-alone plasma vacuum pump according to the invention.
Figure 6:
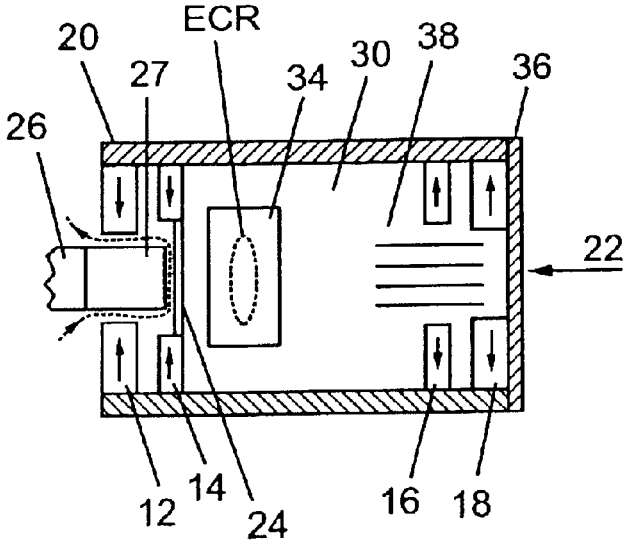
FIG. 6 is a side cross-sectional view of the embodiment of FIG. 5.
Figure 7:
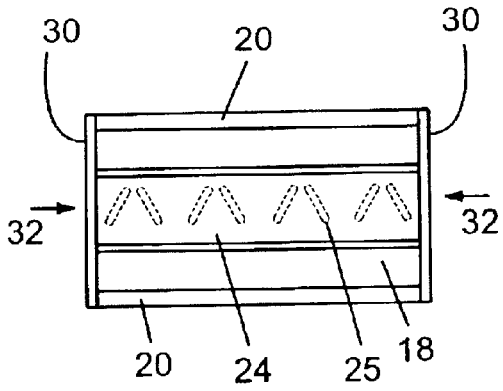
FIG. 7 is an end elevational view in the direction of arrow 22 of FIG. 6.

FIG. 5 is a perspective view of the lower part of a simple rectangular embodiment of a stand-alone plasma vacuum pump according to the invention. FIG. 6 is a side elevational view of this embodiment and FIG. 7 is an end elevational view in the direction of arrow 22 of FIG. 6. This embodiment includes the permanent magnet assembly shown in FIG. 4, a microwave power source is coupled to a plasma via a microwave coupler 26 to maximize the forward transmission of power and a slotted microwave waveguide antenna 27, comprising a means for microwave power transmission and coupling 2. The design of such a system is known in the art. The illustrative antenna shown in the figure is comprised of a slotted waveguide in which the geometry of the slots 25 is designed to radiate the desired polarization and radiation pattern into the resonance region. The slots are in the narrow face of the waveguide antenna 27. Therefore, they are illustrated with dotted lines as seen through the window 24. The antenna can be isolated from the vacuum region by a microwave window 24. Window 24 may be a quarter-wave thick quartz and alumina plate with vacuum seals. Microwave windows employed in other embodiments to be described herein may have the same general composition.

This pump is constituted by a rectangular enclosure formed by pole pieces 20 and two side walls 30 (not shown in FIG. 5, only one side wall shown in FIG. 6) which enclose a pumping region. Source 2 may be composed of a microwave antenna, such as a fundamental mode slotted waveguide antenna. A vacuum seal is formed between source 2 and the pumping region by microwave window 24. Gas to be pumped enters the enclosure in the direction indicated by arrows 32 through inlet openings 34 in side walls 30 on each side of the enclosure. The outlet end of the enclosure, the right-hand end in FIG. 6, is closed by an outlet plate, or end wall 36 (not shown in FIGS. 5 and 7) that defines the pump outlet. The pump outlet will be connected by a suitable coupler or conduit to a fore-pump that withdraws gas to maintain the desired pressure level at the outlet end of the plasma vacuum pump.

Slotted waveguide 27 can be loaded with a dielectric material such as Teflon® in order to reduce the size of the component. Furthermore, as indicated in FIG. 6 by a dashed line, the backside of the window 24 may be cooled via a forced cool nitrogen flow.

As shown in FIG. 6, the pump further includes a baffle structure 38 (not shown in FIGS. 5 and 7) consisting of an array of plates whose length along the magnetic field and relative separation are selected to provide an optimum differential conductance. Plasma flows along the magnetic lines of force without striking the baffle plates; whereas the conductance for gas flowing from the high-pressure outlet end toward the low-pressure inlet end is reduced to appropriate values using standard vacuum art as discussed, for example, by Dushman in Chapter 2 of the work cited earlier. The plates of baffle structure 38 extend across the entire width of the pump.

The embodiment shown in FIGS. 5, 6 and 7 may be operated as follows. Microwave power is radiated into the pump from the antenna of source 2 and absorbed by plasma electrons in a thin region located at the ECR resonant surface. In this region primary electrons gain energy in motion perpendicular to the magnetic field and are heated to energies around 100 eV. At these energies the primary electrons efficiently ionize gas entering the pump through inlet openings 34. Additionally, the primary electrons are accelerated parallel to the magnetic field by virtue of their magnetic moment and tend to move away from the plasma ions, thereby creating a space-charge electric field. The electric field arising from this space charge imbalance accelerates the plasma ions so that ions and electrons move at a common "ambipolar" velocity along the magnetic field and through the pump toward the outlet. This acceleration mechanism is discussed in greater detail below.

A simplified perspective view of a stand-alone plasma vacuum pump according to a cylindrical embodiment of the invention is shown for illustration in FIGS. 8–12. This pump is constituted by a circularly cylindrical enclosure 50 which encloses four pumping regions. The upper end of enclosure 50 is closed by an inlet plate 52 having four openings 54 that define the pump inlet. The lower end of enclosure 50 is closed by an outlet plate 56 having a central outlet opening 58 that defines the pump outlet.

A center septum structure 60 extends along the axis of enclosure 50 between plate 52 and outlet opening 58. Structure 60 separates the plasma and gas flows out of the four axially extending pumping ducts or channels and provides surfaces on which the plasma ions can recombine with plasma electrons to form neutral gas. Structure 60 thus divides the central conduit into four quadrants to prevent plasma and gas from one of the four pumping regions from streaming into adjacent pumping regions.

Microwave antennas 70 are used for plasma formation and heating in each of the four pumping ducts. According to one embodiment of the invention, each antenna is formed by modifying a standard 4-port slot-coupled hybrid coupler to include a tunable impedance matching front end section. Antennas of this general type have been used successfully in plasma sources described in U.S. Pat. Nos. 5,133,826, 5,203,960, and 5,370,765 issued to Raphael A. Dandl. Modifications for adapting the microwave couplers and antennas for particular embodiments are known to those skilled in the art of microwave systems.

Each microwave antenna 70 radiates, for example, 2.45 GHz microwave power into a respective pumping region within enclosure 50 through a respective one of four separate quartz microwave windows 72. This microwave power may be supplied by one or more commercially available sources coupled to antenna 70. The number of sources and the means for distributing the power from individual sources may be dictated by the total power required and the availability of suitable sources. Generally speaking, the pumping speed will be proportional to microwave power, so high-speed pumps may require multiple sources of microwave power. An example of a 2.45 GHz microwave source that is commercially available is an ASTEX 1500 (Maximum output power of 1500 W@ 2.45 GHz). Other sources include an ASTEX S1000i (1 kW) and an ASTEX S700i (700 W).

Figure 8:
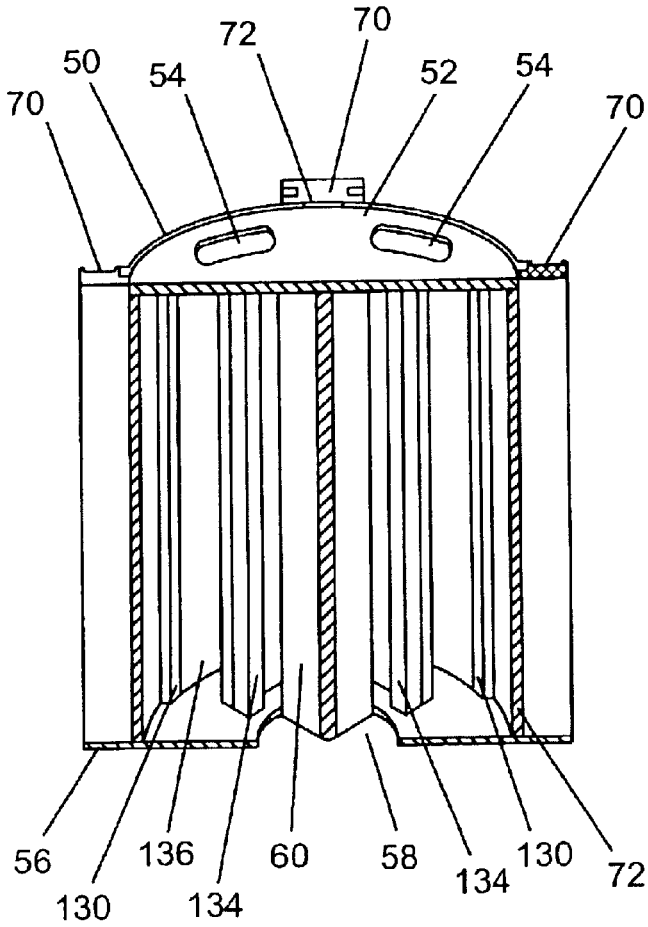
FIG. 8 is a cross-sectional perspective view of a cylindrical embodiment of a stand-alone plasma vacuum pump according to the present invention.

The pump further includes four axially extending outer magnet assemblies mounted at the cylindrical wall of enclosure 50, and four axially extending inner magnet assemblies spaced radially inwardly from the outer magnet assemblies. These magnet assemblies produce four magnetic fields each similar to the magnetic field shown in FIGS. 4–7. As shown in FIG. 8 as well as in FIGS. 9–11, each outer magnet assembly is composed of two axially extending permanent magnets 130 and an axially extending steel pole piece 132 connected between magnets 130 to provide a suitable magnetic flux path. Each inner magnet assembly is composed of two axially extending permanent magnets 134 and an axially extending steel pole piece 136 connected between magnets 134 to provide a suitable magnetic flux path. Each steel pole piece 132, 136 may be made, for example, of 1010 steel.

Figure 9:
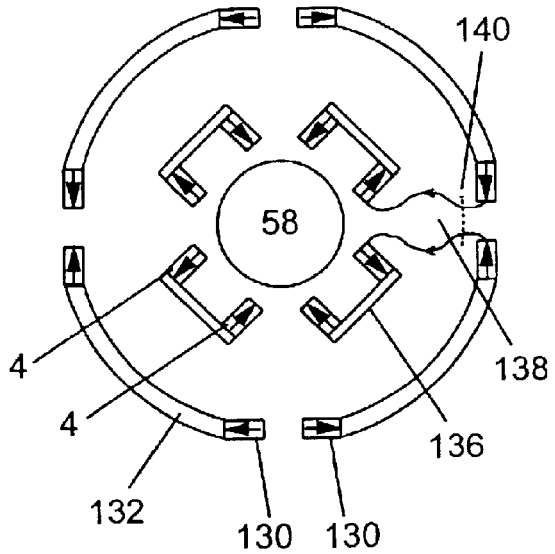
FIG. 9 is a simplified plan view depicting the arrangement of magnetic field producing components in the pump of FIG. 8.

FIG. 9 shows the orientation and the directions of magnetization of magnets 130 and 134 and their relation to pole pieces 132 and 136. The directions of magnetization are indicated by thick arrows drawn in the magnets. Appropriate magnetic circuits are formed by orienting magnets 130 and 134, together with pole pieces 132 and 136, as shown especially in FIG. 9.

The magnetic flux in the air gaps between adjacent pairs of inner and outer magnets forms flux channels that are specifically shaped to function as plasma pumping channels 138. Thus, in the illustrated cylindrical embodiment there are four such pumping channels. The more constricted portions at the outlet ends of the magnetic flux channels pass through suitably designed orifices which form baffles which, as described earlier herein, impede flow of ions back into the flux channels. In the cylindrical embodiment, a set of baffles represented by slats are shown in dashed lines for a single quadrant in FIGS. 10 and 11.

The strength and dimensions of magnets 130 and 134 are selected to generate an electron cyclotron resonance surface 140 (FIG. 11) corresponding to ECR in FIGS. 2 and 6, in a region located near each microwave antenna 70. For microwave power at 2.45 GHz, for example, this is the surface on which the magnetic field strength is 875 Gauss. Each microwave antenna 70 is located in a region where the magnetic field strength, $B_{max1}$, is typically 1.2 to 1.5 times higher than this resonance value, i.e., 1100 to 1300 Gauss. For this reason, this type of electron cyclotron heating is usually referred to as "high-field launch". The characteristics of high-field launch electron cyclotron heating are discussed in greater detail in a later section.

Figure 10:
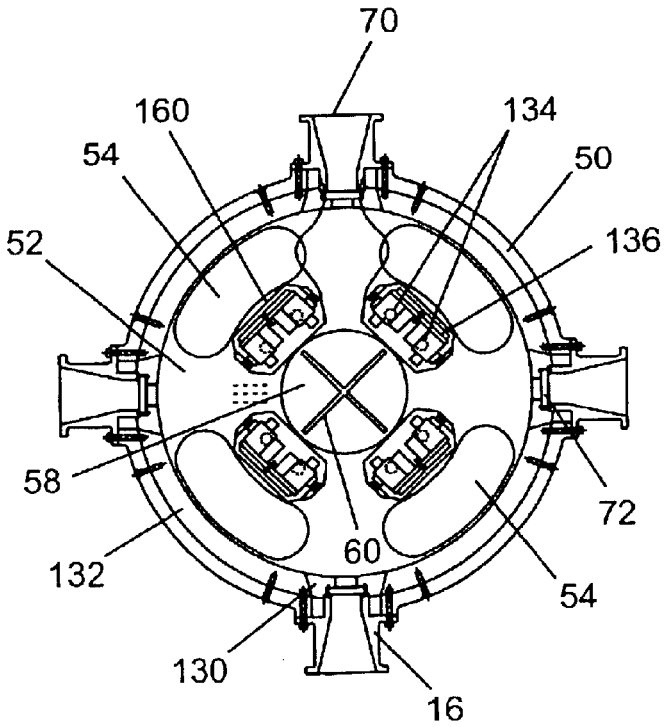
FIG. 10 is a bottom plan view, with a bottom panel removed, of the interior of the pump of FIG. 8.

FIG. 10 shows various details of one exemplary practical form of construction of a pump according to the invention. This figure shows that each antenna 70 may include a tapered wave guide to match the hybrid couplers to the pump geometry.

Figure 11:
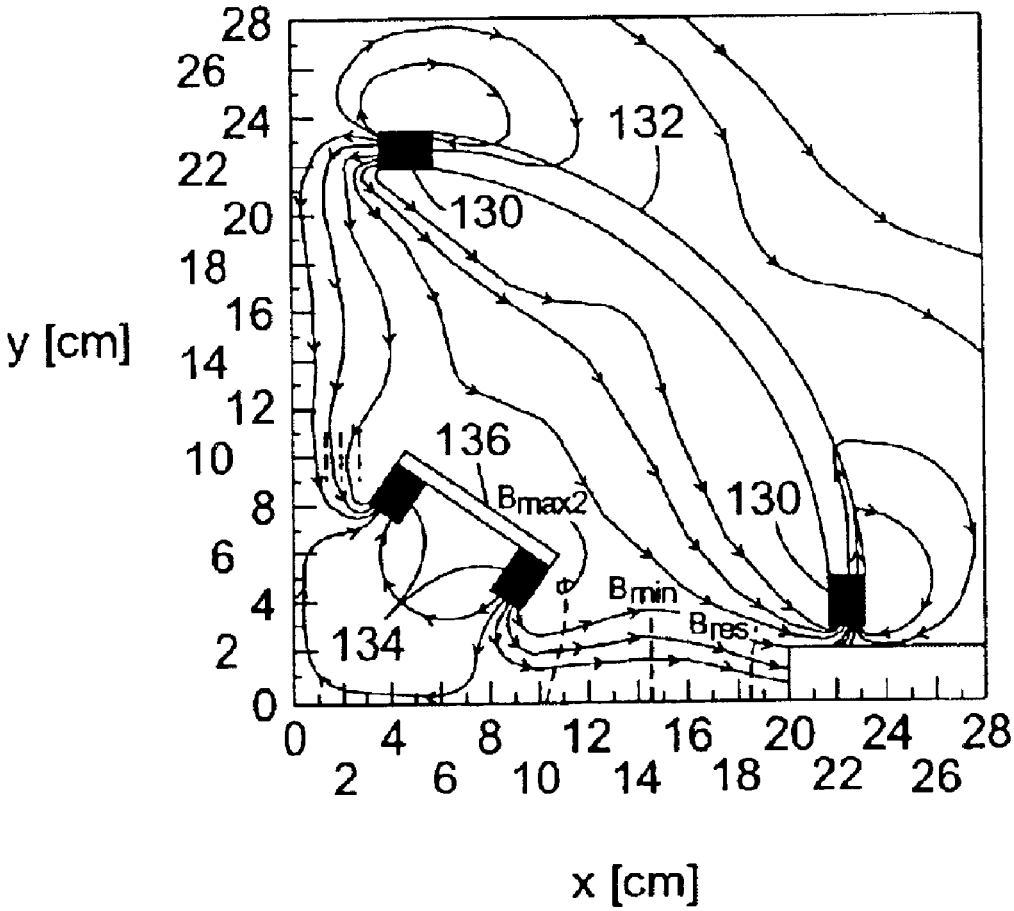
FIG. 11 is a detail plan view illustrating a portion of the magnetic field associated with a permanent magnet assembly in the pump of FIG. 8.

An example of the magnetic flux surfaces created by the magnetic structures is shown in FIG. 11. The lines appearing in FIG. 11 represent magnetic lines of force and are everywhere directed in the direction of the local magnetic field. The dotted lines appearing in the figure indicate the location of surfaces on which the magnetic field strength takes on the constant values $B_{res}$, $B_{min}$, and $B_{max2}$. These are, respectively, the resonant field strength (875 Gauss for 2.45 GHz microwave power), and the minimum and maximum magnetic field strengths along the center line of the flux channels shown. Two local flux channels, each corresponding to flux channel 138 in FIG. 9 ) are formed near the vertical and horizontal boundaries, respectively (that is, the ordinate and abscissa) of FIG. 11. One half of each of the flux channels is shown in FIG. 11, so the ordinate and abscissa of this figure also represent the center planes of those two flux channels. Along each center plane the flux density pattern has the form shown in FIG. 3 Note that these flux channels extend axially the entire length of the pump and the magnetic field lines extend radially between the outer magnet assemblies and the inner magnet assemblies.

As shown particularly in FIG. 10, microwave power is radiated through microwave windows 72 into each plasma pumping duct of the pump by the four antennas 70. The magnetic field lines are directed inwardly or outwardly in radial directions, depending on the direction of the magnetization of the particular magnet pair forming that duct, as shown in FIG. 9. The pumping mechanisms described earlier herein do not depend on the sense of the magnetic field but only on the sense of the gradient in field strength.

The pump inlet of the cylindrical stand-alone plasma vacuum pump shown in FIGS. 8–12 can be made as large as desired and the pump can be provided with additional plasma channels. This pump does not use any mechanical parts or pumping oils, so that it can be attached directly to the processing system without contaminating the vacuum system. The only pumping "fluid" used in the plasma pump is the gas from the system to be pumped.

According to a further feature of the embodiment shown in FIGS. 8–11, and as identified in FIG. 10, each inner magnet assembly is enclosed by a wall 160 of nonmagnetic material, preferably aluminum, that extends over the entire length, or height, of enclosure 50 between plates 52 and 56. Walls 160 delimit the outlet end portions, and in particular the constricted portions, of the pumping ducts to separate the gas flow regions of the pumping ducts from one another. At these end portions, the magnetic lines of force of the flux channels are tangential to the associated surfaces of walls 160.

It will be noted that in a pump according to the invention gas to be pumped can enter each duct in any direction perpendicular to the pumping direction. In the embodiment of FIGS. 3–7 the gas flows parallel to the magnetic flux planes, or to the width of each channel; in the embodiment of FIGS. 8–11, the inlet flow is perpendicular to the magnetic flux planes.

The multi-channel plasma configuration provides a large plasma surface for ionizing gas molecules which enter the plasma pump. Thus this pump is capable of pumping a large gas load. The 4-channel pump can be designed to have a total plasma surface area, i.e., the total area over which gas that has passed through inlet openings 54 can enter the four pumping ducts, of greater than 1000 $cm^2$ and is capable of pumping a gas load of 10 Torr liter/sec or higher. The gas entering the pump through inlet openings 54 is first ionized by the fast electrons heated by microwave power launched from the antennas in the high magnetic field regions. The plasma parameters that can be obtained in this way are in the ranges of: $n_i=10^{12-1013}$ $cm^{-3}$; $T_e$=3–10 eV, and degree of ionization=1–10%, where $n_i$ is the plasma density and $T_e$ is the secondary electron temperature.

The plasma is produced in magnetic flux channels 138 that guide the plasma flow to the outlet end of each flux channel while back streaming of the gas is impeded by orifices bounding the flux channels. The plasma throughput resulting from the free flow of plasma along the magnetic fields is about 10–30 Torr·liter/sec.

The present invention employs collective plasma acceleration to further enhance the plasma throughput by a factor of 3 to 5. The plasma acceleration results from the microwave heating dynamics and the magnetic field design. It does not require additional hardware components.

Finally, the magnetic field configuration downstream of plane d in FIG. 2 is designed to further increase the compression ratio so that the outlet pressure, measured at the outlet plane of the pump operates in the range from $10^{-2}$ to 1 Torr. The operating inlet pressure at inlet openings 54 is in the range from $10^{-5}$ to $10^{-2}$ Torr.

Details on the theory of the operation of the stand-alone plasma vacuum pump are described below. Specifically, there will be presented a description of: the plasma vacuum pump requirements; the magnetic field designs and calculations; the formation and heating of the over-dense plasma using high-field launched whistler wave heating at a microwave frequency of 2.45 GHz; the collective plasma acceleration mechanism employed in the present invention; and the momentum transfer pumping mechanism.

Plasma Vacuum Pump Requirements:

Plasma Surface Area:

For a given gas throughput ("load") $Q_o$ the plasma pump must provide a pumping speed $S_o$ large enough to maintain the desired operating pressure P. The required pumping speed is given by:

$$S_o=Q_o/P$$

The pumping speed is a volume flow rate having the units of volume per unit time, i.e. liters per second. The operating pressure is assumed to be the operating pressure of the pumping ducts and the pumping speed is the volume flow rate through the total summation of the "outer" magnetic field surfaces; these surfaces are referred to later as the vacuum - plasma interface.

For a plasma vacuum pump, gas molecules must be ionized before they are removed or pumped out of the system. Since the gas molecules enter the plasma with a characteristic speed $v_o$, the plasma surface area must be large enough to allow the gas to flow into the plasma at a rate corresponding to the desired pumping speed. The required plasma surface area, A, is given by $$S_o=\tfrac{1}{4}v_o\cdot A \tag{2}$$

where $S_o$ is the desired pumping speed, A is the total surface area of all surfaces of the vacuum-plasma interface and $v_o$ is the gas velocity normal to these surfaces integrated on these surfaces. In the embodiment of FIGS. 8-12, the vacuum-plasma interface would include both lateral sides of every channel 138 though which gas flows into the four flux channels. The factor ¼ in Equation (2) comes from the three dimensional effect: the first ½ accounts for the fact that half of the molecules flow in the direction of the pump, and the second ½ accounts for the integration of the directional cosine of the velocity vector. If the plasma surface area is too small, the gas molecules cannot flow into the plasma at a rate that is sufficient to provide the desired pumping speed. The situation is similar to gas flow limited by a poor conductance.

Ion Throughput:

The ion throughput is given by the ion flow equation:

$$Q_{ion}=\tfrac{1}{4}n_i\cdot v_i A_p \tag{3}$$

Here, $Q_{ion}$ is the total ion throughput through all of the pumping ducts, $n_i$ is the ion density, $v_i$ is the ion velocity, and $A_p$ is the total cross sectional area of all of the channels through which the plasma flows. Here the factor ¼ is the three-dimensional effect, as in the case of neutral gas flow. Because the ion density and the ion velocity are both limited within narrow parameter ranges, the cross-section area must be large enough to produce a large ion throughput. For a typical plasma density of $n_i=5\times10^{12}$ $cm^{-3}$ and Te=5 eV (the ion velocity is $v_i\approx3\times10^5$ cm/sec for Ar), to achieve the ion throughput, namely, $Q_{ion}\approx10$ Torr liter/sec $3\times10^{20}$ particle/sec, the required cross section area is quite large:

$$A_p=4Q_{ion}/(n_i\cdot v_i)=1000\ cm^2 \tag{4}$$

Differential Pressure:

The balance between the gas load and the throughput of the pump will determine the differential pressure between the pump inlet and the pump outlet:

$$Q_o=Q_{pump}+C(P_{in}-P_{out}) \tag{5}$$

where $Q_{pump}$ is the throughput generated by the pump, C is the pump conductance, $P_{in}$ is the inlet pressure, and $P_{out}$ is the outlet pressure. The compression ratio of the pump is defined as $P_{out}/P_{in}$. The differential pressure and the compression ratio can be expressed as $$(P_{in}-P_{out})=(Q_o-Q_{pump})/C \tag{6}$$

and $$P_{out}/P_{in}=(Q_{pump}-Q_o)/CP_{in}+1 \tag{7}$$

From Equation (7), it becomes clear that $Q_{pump}$ must be greater than $Q_o$ in order to produce a compression ratio greater than one. In the present invention, several enhancements are employed to enhance the pumping throughput. Symbolically $$Q_{pump}=\beta Q_{ion} \tag{8}$$

Here β is the enhancement factor: making $\beta \geqq 100$ is possible with the enhancement mechanisms implemented, as described in detail in the following sections.

Magnetic Field Configuration:

The magnetic field described herein for implementing the present invention was designed using the 2-dimensional SUPERFISH-PANDIRA code and the 3-dimensional ANSYS/Multiphysics code v5.4. Designs for rectangular plasma pumps and cylindrical plasma pumps with 4, 6, and 8 plasma channels have been generated. The 4-channel configuration is shown in FIGS. 8–11. FIG. 11 shows only one half of each of two mirror sections. The other halves are created by symmetry reflection of the configuration, including directions of magnetization, with respect to the straight edges (i.e., x and y axes). Such symmetry reflections are repeated until the entire array is complete. The magnetic field is oriented along these symmetry lines; i.e., a flux-parallel boundary condition is imposed.

In each quadrant of the 4-channel pump, an auxiliary pair of rectangular magnets 134 and a pole piece 136 are used near the center region to optimize the local mirror fields in the following manner:

The magnetic flux channels 138 extend from the local magnetic field maximum $B_{max2}$ towards the cylindrical axis of enclosure 50 in order that they can guide the plasma to flow into the pumping ducts in a one-dimensional manner.

Much of the radially inwardly directed magnetic flux is connected to magnets 134 and then returned to outer magnets 130. This further improves the magnetic field strength in the mirror region. The mirror region is, in general, the region extending radially between the two maxima in the magnetic field, i.e. the region between the two B-field maxima, $B_{max1}$ and $B_{max2}$ in FIGS. 3 and 11.

The ECR resonance ($B_{res}$=875 gauss for 2.45 GHz microwave frequency) surfaces 140 are positioned several inches inwardly from outer magnets 130, allowing outer magnets 130 to be located outside of the vacuum vessel.

The magnetic field strength, $B_{max1}$, in the gap between each pair of outer magnets 130 is significantly higher than the resonant field, $B_{max1}/B_{res}=1.2$, in order that the wave-guide antenna located here can excite whistler waves from the high field side for "high-field launch" heating. The magnetic field strength, $B_{max1}$, is at the peak of the curve in FIG. 3 to the right of $B_{res}$.

The resonant surfaces (ECR) are found at the location where $B_{res}$=875 gauss, in the region of radially inwardly decreasing magnetic field strength between the location of $B_{max1}$ and $B_{min}$ pointing radially to the pumping ducts. The magnitude of field gradient is optimized for improved electron heating.

The flux channels are converging downstream, from $B_{min}$ to $B_{max2}$. to guide the plasma to the outlets of the pumping ducts and into the quadrants formed by structure 60. Gas is then pumped along these quadrants to outlet 58 by a pump (not shown, coupled to outlet 58. The local field maximum, $B_{max2}$, however, is made smaller than the resonant field strength.

The field minimum, $B_{min}$, in the mirror region is significantly lower then the resonant field strength to allow efficient plasma acceleration.

Formation and Heating of Over-Dense Plasmas:

As discussed by, for example, B. H. Quon and R. A. Dandl, "Preferential electron-cyclotron heating of hot electrons and formation of overdense plasma", in Physics of Fluids B1, (10), October 1989; and G. E. Guest, M. E. Fetzer, and R. A. Dandl, "Whistler-wave electron cyclotron heating in uniform and nonuniform magnetic fields", in Physics of Fluids B2(6), June 1990, experience in electron cyclotron heating plasma technology has proven that strong wave absorption occurs and over-dense plasma is generated when whistler waves are launched toward the resonant zones from locations of higher magnetic field strength: $B>B_{res}$, where $B_{res}=2\pi f_{\mu}/(m/e)$. Here $f_{\mu}$ is the applied microwave frequency, and e and m are the electron charge and mass, respectively. The whistler waves propagate into the plasma with $$E(z,t)=E_{\perp}(z)\cos(\omega t-kz\cos\theta) \tag{9}$$

In this expression, k is the magnitude of the wave-number vector, E is the microwave electric field strength with component $E_{\perp}$ perpendicular to the static magnetic field, z is the distance along a magnetic field line, and $k=2\pi/\lambda$ is the magnitude of the propagation vector of the waves whose wavelength and (angular) frequency are λ and ω, respectively.

The whistler wave is the right-hand circularly-polarized mode described by the dispersion relation $$n^2=1-\alpha\omega)/(\omega-\Omega\cos\theta) \tag{10}$$

where $n^2=(kc/\omega)^2$ is the square of the refractive index, $\alpha=(\omega_{pe}/\omega)$, and $\Omega=eB/m$, θ is the angle between the wave vector, k, and the magnetic field, B, c is the speed of light, e is the electron charge, m is the electron mass, $\omega_{pe}$ is the electron plasma frequency and ω is the angular frequency of the wave. For small θ, the power absorbed by the plasma is expected on the basis of theory to be given by:

$$P_{abs}=P_o[1-exp(-\int 2k_i dz)] \tag{11}$$

$$k_i \approx \|\omega_{pe}^2\omega/(2c^2k^2v_e)exp\{-[(\omega-\omega_{ce})/kv_e]^2\}\| \tag{12}$$

where $P_{abs}$ is the absorbed power, $P_o$ is the incident wave power, and $k_i$ is imaginary part of the wave number, $\omega_{ce}=eB/m$ is the cyclotron frequency and $v_e=(2T_e/m)^{1/2}$ is the electron thermal speed.

With microwave power launched at $\omega_{ce}/\omega=1.2$–$1.5$ from a matched antenna or a wave-guide horn with a quarter-wave window, the whistler wave will propagate mainly along the magnetic field lines, with a corresponding reduction in wavelength (e.g. increasing k) and strong attenuation (e.g. increasing $k_i$) by plasma absorption. Wave absorption occurs where the Doppler-shifted resonance condition $$\omega-\omega_{ce}=k\cdot v=kv\cos\theta \tag{13}$$

is satisfied. Electrons with $|v_{\|}\leqq 2v_e$ are able to resonate with the wave. For $T_e\approx 6$ eV, the resonant zone covers magnetic field strengths in the interval $810\leqq B\leqq 940$ G, or $$\omega_{ce}/\omega=0.92-1.08.$$

Notice that in the high field side, $v_{\|}$ is negative; i.e., the heated electrons are moving toward the antenna. These heated electrons are reflected by the higher magnetic field at the front surface of the antenna.

The typical plasma density generated by whistler waves launched in the high-field region is in the range of $1$–$3\times10^{12}$ $cm^{-3}$ without antenna tuning. To achieve still higher plasma density, a special coupling network and a low-impedance antenna will be provided. Standard 4-port, side-wall hybrid couplers, wave-guide transitions with low impedance horns and quarter-wave quartz windows will be provided to achieve higher plasma density. Wave-guides filled with alumina will be used to reduce the dimensions of the network when necessary. Such a coupling network and antenna can be obtained by modifying available hardware in ways that are already known in the art.

Plasma Acceleration Techniques:

Electron cyclotron heated electrons gain kinetic energy in motion perpendicular to the magnetic field lines of force:

$$W_{\perp}=\tfrac{1}{2}mv_{\parallel}^2 \tag{14}$$

As discussed, for example, by David J. Rose and Melville Clark, Jr., in *Plasmas and Controlled Fusion*, The M.I.T. Press and John Wiley&Sons (1961) especially Chapter 10, the motion of electrons in the space beyond the resonant interaction zone can be described in terms of their total energy, $\epsilon$, and magnetic moment, $\mu$:

$$\epsilon=W_{\perp}+W_{\parallel}-e\phi \tag{15}$$

$$\mu=W_{\perp}/B \tag{16}$$

Here $\phi$ is any electrostatic potential that may be present, and $$W_{\parallel}=\tfrac{1}{2}mv_{\parallel}^2 \tag{17}$$

Outside of the resonant interaction zones, $\epsilon$ and $\mu$ remain constant due to conservation of energy and the magnetic moment, if the magnetic field does not vary too rapidly in space.

The electrons experience a force parallel to the magnetic field, $F_{\parallel}$:

$$F_{\parallel}=-\mu\nabla B=-(W_{\perp,res}/B_{res})(dB/ds_{\parallel}) \tag{18}$$

Thus, in the absence of electrostatic fields, the "parallel" kinetic energy of the electrons at any point beyond the resonant surface is given by $$\begin{aligned} W_{\parallel} &= \int_{s_{res}}^{s} F_{\parallel}ds \\ &= -W_{\perp,res}/B_{res}\int_{s_{res}}^{s}(dB/ds_{\parallel})ds_{\parallel} \\ &= -W_{\perp,res}/B_{res}[B(s)-B_{res}] \\ &= W_{\perp,res}[1-B(s)/B_{res}] \end{aligned} \tag{19}$$

For a magnetic flux channel extending radially as shown in FIG. 11, one can define a coordinate system such that the s-direction is along the flux channel centerline. "s" is a distance or location along the flux channel centerline taken from a reference location that may be arbitrarily defined. "B(s)" is the magnetic field strength at this location, or on the surface of constant magnetic field strength at this location and normal to the flux lines. "$s_{res}$" is the location of the surface normal to the flux lines upon which the magnetic field strength is constant and equal to the resonant value.

Equation (19) signifies that electrons are accelerated radially inwardly parallel to a spatially decreasing magnetic field in the direction antiparallel to the gradient. Since heated electrons are being accelerated but ions are not, charge separation will result and an electrostatic potential, $\phi$, will build up. This potential will retard the electrons and accelerate the ions until both species of particles have the same "ambipolar" parallel drift velocity.

For the electrons, $$\begin{aligned} \varepsilon_e &= W_{\perp}+W_{\parallel}-e\varphi \\ &= W_{\perp,res}[1-B(s)/B_{res}]+e(\varphi-\varphi_{res}) \end{aligned} \tag{20}$$

since $W_{\perp}=\mu B=W_{\perp,res}B/B_{res}$. For singly-charged ions of charge e, $$\begin{aligned} W_{\parallel,i} &= \int_{s_{\parallel}}^{s} e(-\partial\varphi/\partial s_{\parallel})ds_{\parallel} \\ &= -e(\varphi-\varphi_{res}) \end{aligned} \tag{21}$$

where the subscript e denotes electron.

Adding the ion equation (21) and the electron equation (20) yields $$W_{\parallel,e}+W_{\parallel,i}=W_{res}(1-B/B_{res}) \tag{22}$$

Where the subscript i denotes ion.

In equilibrium, since $v_{\parallel,}=v_{\parallel,e}=v_a$, the "ambipolar" speed, $$\tfrac{1}{2}mv_a^2+\tfrac{1}{2}Mv_a^2=W_{res}(1-B/B_{res}) \tag{23}$$

or $$v_a=[2W_{res}(1-B/B_{res})/(M+m)]^{1/2} \tag{24}$$

where M is the ion mass.

It is important to ensure that the plasma is not reflected or significantly retarded by the magnetic field as the plasma approaches the local region of high magnetic field near the outlet ducts. The condition for the plasma to flow through the local field maximum, $B_{max}$, can be expressed as $$\tfrac{1}{2}Mv_a^2\approx W_{res}(1-B_{max}/B_{res}) \tag{25}$$

where the ion kinetic energy is given by equation (25). Thus the local field maximum should not be higher then the resonant field.

Momentum Transfer Pumping Mechanism

The moving plasma ions are subject not only to inertial force and field forces, but also to stochastic effects that cause them to be diffused or to be impeded in their motion. Momentum transfer collisions can induce these effects in the presence of an electric field. In this case, the plasma-associated throughput is modified to include a term proportional to the ion mobility, $\mu$:

$$Q_p=n_i\cdot v_i\cdot A_{p+E\cdot\mu\cdot n_i}\cdot A_p \tag{26}$$

Here E is the electric field. Denoting $v_d=E\mu$, where $v_d$ is the ion drift velocity, the ion throughput can be expressed as:

$$Q_p=n_i(v_i+v^d)A_p=n_i\cdot v_i(1+v_d/v_i)A_p \tag{27}$$

If $(1+v_d/v_i)$ is replaced by $\beta_{\mu}$, then $$Q_p=\beta_{\mu}n_i\cdot v_i\cdot A_p \tag{28}$$

With large E at high pressure, the value of $\beta_{\mu}$ can be large.

The pumping throughput is actually higher when the neutral drift velocity is included. In fact, most of the neutral molecules in the system under consideration are also drifting with nearly the same drift velocity, owing to the ion-neutral momentum transfer collisions. Thus the total pumping throughput is:

$$Q_{pump} = n_i \cdot v_i(1 + v_d/v_i)A_p + n_o \cdot v_d A_p \quad (29)$$
$$= [1 + (v_d/v_i) + (v_d/v_i)(n_o/n_i)]Q_p$$
$$= \beta_t Q_p$$

$$\beta_t = [1 + (v_d/v_i) + (v_d/v_i)(n_o/n_i)]$$

Here $n_o$ is the neutral gas number density and $\beta_t$ is the enhancement factor for the ion and neutral flows. Experimental testing in a single plasma duct has confirmed a large enhancement using the momentum transfer pumping technique according to the present invention.

The method and apparatus according to the invention can also be used for pyrolyzing effluent gas by operating the pump in the manner described above and supplying effluent gas to the pump inlet. A stand-alone plasma vacuum pump according to the invention is capable of pumping any constituents in gaseous form as long as the ionization of the gasses leads to a predominantly electro-positive plasma.

While the description above refers to particular embodiments of the present invention, it will be understood that many modifications may be made without departing from the spirit thereof. The accompanying claims are intended to cover such modifications as would fall within the true scope and spirit of the present invention.

The presently disclosed embodiments are therefore to be considered in all respects as illustrative and not restrictive, the scope of the invention being indicated by the appended claims, rather than the foregoing description, and all changes which come within the meaning and range of equivalency of the claims are therefore intended to be embraced therein.

What is claimed is:

1. A stand alone plasma vacuum pump for pumping gas from a low pressure inlet end to a high pressure outlet end, said plasma pump comprising:

a housing enclosing at least one pumping region located between said inlet end and said outlet end;

a permanent magnet assembly providing at least one magnetic field that extends in said pumping region between said inlet end and said outlet end, said magnetic field providing a magnetic flux channel for guiding and confining a plasma, said channel having a first portion in which the magnetic field has a negative intensity gradient in the direction from said inlet end to said outlet end; and a microwave source providing microwave energy into said flux channel to create a plasma by ionizing gas in said channel and to excite electrons in said first portion of said channel to a resonance state such that interaction between the electrons and the magnetic field creates forces that propel the electrons and ions in the plasma to the outlet end.

2. The plasma vacuum pump according to claim 1 wherein said channel has a second portion located between said first portion and said outlet end and in which the magnetic field has a positive intensity gradient in the direction from said inlet end to said outlet end.

3. The plasma vacuum pump according to claim 2 wherein the negative intensity gradient has a larger magnitude than the positive intensity gradient.

4. The plasma vacuum pump according to claim 2 wherein said channel has a third portion located between said second portion and said outlet end and in which the magnetic field has a negative intensity gradient in the direction from said inlet end to said outlet end.

5. The plasma vacuum pump according to claim 4 wherein:

said third portion includes a baffle for impeding flow of ions from said outlet end to said inlet end;

said pumping region is cylindrical with a longitudinal axis; and said magnetic flux channel extends in a direction transverse to said longitudinal axis from said inlet end to said outlet end.

6. The pump according to claim 5 further comprising an element provided with a plurality of narrow slots associated with said baffle and disposed in said pumping channel between said first portion and said third portion for minimizing flow of electrically neutral gas molecules from said outlet end toward said inlet end.

7. The plasma vacuum pump according to claim 2 wherein said microwave power source is a microwave antenna communicating with said flux channel.

8. The plasma pump according to claim 7 wherein said antenna is a four-port side-wall hybrid coupler with an impedance tuning transition.

9. The plasma pump according to claim 7 wherein the said antenna comprises a waveguide having a waveguide window with a narrow opening and is pressurized with forced cool nitrogen gas to cool said window and to suppress waveguide and window arcs.

10. The plasma pump according to claim 9 wherein the said waveguide window is made of quarter-wave thick quartz and alumina plate with vacuum seals.

11. The plasma pump according to claim 9 wherein said antenna further comprises walls having alumina liners in a region from said waveguide window extending beyond a resonant zone in said flux channel.

12. The pump according to claim 11 wherein said at least one pumping region is a plurality of pumping regions, said permanent magnet assembly provides a plurality of magnetic flux channels each in a respective pumping region, and said pump further comprises a septum which prevents mass flow from one of said pumping regions to another.

13. The pump according to claim 1 wherein said permanent magnet assembly and said means disposed for coupling microwave power are configured for optimizing acceleration of electrons along said flux channel to produce collective plasma acceleration toward said outlet end of said pumping region.

14. The pump according to claim 1 wherein:

said permanent magnet assembly produces a magnetic field having an electron cyclotron resonant surface of constant magnetic field strength $B_{res}$ in said flux channel;

said magnetic flux channel contains a region within which the magnetic field strength exceeds $B_{res}$ by a factor of greater than 1.2 at a location proximate to said microwave source;

the magnetic field strength in said flux channel has a minimum value substantially less than $B_{res}$ between said resonant surface and said outlet end; and the magnetic field strength has a local maximum value less than $B_{res}$ on a surface proximate to said outlet end.

15. A method of pyrolyzing effluent gas comprising:

placing the pump according to claim 1 into operation; and supplying effluent gas to said pump inlet end.

16. A method of pumping gas out of a low pressure region, comprising:

placing the inlet end of the pump according to claim 1 in communication with the low pressure region; and operating the pump to pump gas out of the low pressure region.

* * * * *